United States Patent [19]

Dittman et al.

[11] 4,331,880

[45] May 25, 1982

[54] AUTOMATIC START/STOP APPARATUS FOR CYCLICAL ENGINE OPERATION

[76] Inventors: Donald C. Dittman, 5207 W. Cedar Bayou Lynchburg Rd.; Paul W. Kendrick, 922 W. Cedar Bayou Lynchburg Rd.; Leon J. Thibodeaux, 1619 Willow, all of Baytown, Tex. 77520

[21] Appl. No.: 75,259

[22] Filed: Sep. 13, 1979

[51] Int. Cl.[3] ..... F02N 17/00

[52] U.S. Cl. ..... 290/38 R; 123/179 BG; 361/195

[58] Field of Search ..... 123/179 B, 179 BG; 290/38, 37 R; 307/141.4, 141, 143; 361/196, 29, 195, 202, 206; 320/48

[56] References Cited

U.S. PATENT DOCUMENTS

| | | | |
|---|---|---|---|
| 2,497,948 | 2/1950 | Lincoln | 290/2 |
| 2,634,682 | 4/1953 | Dye | 103/22 |
| 2,924,209 | 2/1960 | Schott | 123/179 B |
| 2,991,370 | 7/1961 | Sutton | 290/38 |
| 2,991,860 | 7/1961 | Dye | 123/179 B |
| 3,248,555 | 4/1966 | Fried | 290/38 |
| 3,653,699 | 4/1972 | Podesta et al. | 290/37 |
| 3,740,564 | 6/1973 | Wong | 290/38 |
| 3,942,024 | 3/1976 | Ingham | 290/38 R |
| 4,144,552 | 3/1979 | Sibalis | 361/166 |
| 4,200,080 | 4/1980 | Cook et al. | 123/79 BG |

*Primary Examiner*—J. D. Miller
*Assistant Examiner*—Donald L. Rebsch
*Attorney, Agent, or Firm*—Frank S. Vaden, III; Emil J. Bednar

[57] ABSTRACT

Automatic control apparatus for starting and then stopping and for continuing cyclical operation of an engine including two timer means, one for determining the running/not running ratio of the engine and the other for determining how long starting power is applied to the engine start system, typically the solenoid of a starter motor. One embodiment includes a vacuum switch for sensing and preempting the second timer operation when the engine is started and there is a vacuum present in the manifold. The preferred embodiment also includes adjustable controls for setting both timer means, these same means having switching contacts capable of carrying full power to the solenoid or other engine start component.

11 Claims, 2 Drawing Figures

AUTOMATIC START/STOP APPARATUS FOR CYCLICAL ENGINE OPERATION

BACKGROUND OF THE INVENTION

1. Field of the Invention

This invention pertains to automatic controls for operating an engine in an unattended situation and specifically for starting and then stopping an engine at periodic intervals.

2. Description of the Prior Art

A producing oil well is normally produced utilizing a continuously running natural gas or butane powered engine. Such an engine is conventionally connected to a pumping unit that could pump a well dry if operated at full efficiency. This is because the oil which is pumped from the well normally does not flow into the well from the adjacent formation at nearly the rate to match the production capacity of an efficiently operated pumping unit. The permeability of the formation, the formation pressure, the oil viscosity and the other environmental factors involved acting together to naturally fill a well typically operate to fill the well at about one-third of the rate at which the well can be efficiently produced.

In order to prevent the pumping equipment from pumping the well dry, the pumping equipment must somehow be restrained. This is done typically by restricting the pump or by choking it against full stroke operation or by operating the engine at a lesser than full rpm.

It is recognized that continuous operation of the engine and the related pumping equipment is not only inefficient if not required for production purposes, but also wears out the equipment faster than if the equipment were operated periodically or at intervals. The reason that equipment is not operated at intervals is due primarily to two factors: many sites are remote from personnel and are difficult to manually operate on a periodic basis and there is little incentive to efficiently operate such equipment because of the ready availability of fuel at the source.

However, it is now believed that operating the well at intervals actually is a more efficient production method than a continuously pumped well. In addition, the wear and tear on the equipment as well as the periodic maintenance makes it well worthwhile to operate the equipment periodically rather than continuously and even permits the use of equipment for longer periods of time before maintenance is required provided that a reliable and inexpensive control system is available for starting and stopping the engine at periodic intervals.

The automatic control apparatus for starting and stopping an unattended motor can be too complicated. The more mechanical parts, involved, the more likely that there will be a malfunction. For example, U.S. Pat. No. 2,924,209 reveals an apparatus allegedly capable of starting and stopping an engine without manual attention in an application such as running an engine at an oil well pump location; however, the structure is bulky and complex. It is not known to have been commercialized, perhaps for that reason. U.S. Pat. Nos. 2,634,682 and 2,991,860 reveal other complex control apparatus for a similar purpose.

U.S. Pat. No. 2,991,370 reveals a representative state-of-the-art system designed to start the engine of an automobile at a preselected time to permit the engine to warm up prior to use. U.S. Pat. Nos. 3,248,555; 3,538,898; and 3,942,024 reveal other control apparatus for a similar purpose.

The following patents disclose the use of a vacuum switch to deenergize a starter motor once an engine has started: U.S. Pat. Nos. 2,497,462; 2,948,104; and 2,949,105. A system using a thermal device for such purpose is shown in U.S. Pat. No. 2,174,101.

Finally, a sophisticated, but extremely complex, automatic control system for a gasoline-powered internal combustion engine is shown in U.S. Pat. No. 4,013,056.

Therefore, it is a feature of the present invention to provide a relatively trouble-free and economical automatic start/stop control device for unattended operation of an engine using simplified connections with readily available components.

SUMMARY OF THE INVENTION

The automatic control apparatus disclosed herein utilizes two timer means. The first determines the duration which the engine will run once started, normally on the order of 2–10 hours. The second determines how long power will be applied to the solenoid connected to the starter motor. In a first embodiment, the starting power is applied for 7–11 seconds. In a second embodiment, the starting power is applied until a vacuum switch opens to indicate that the motor is running, but in no event longer than about 30 seconds.

The preferred embodiment of the invention utilizes timers that are conventionally adjustable and which have switch contacts capable of carrying load current directly to the solenoid so that auxiliary power relays for carrying such a load current are avoided.

BRIEF DESCRIPTION OF THE DRAWINGS

So that the manner in which the above-recited advantages and objects of the invention, as well as others which will become apparent, are attained and can be understood in detail, more particular description of the invention briefly summarized above may be had by reference to the embodiments thereof which are illustrated in the appended drawings, which drawings form a part of this specification. It is noted, however, that the appended drawings illustrate only typical embodiments of the invention and are therefore not to be considered limiting of its scope, for the invention may admit to other equally effective embodiments.

In the Drawings.

DESCRIPTION OF PREFERRED EMBODIMENTS

Figure 1:
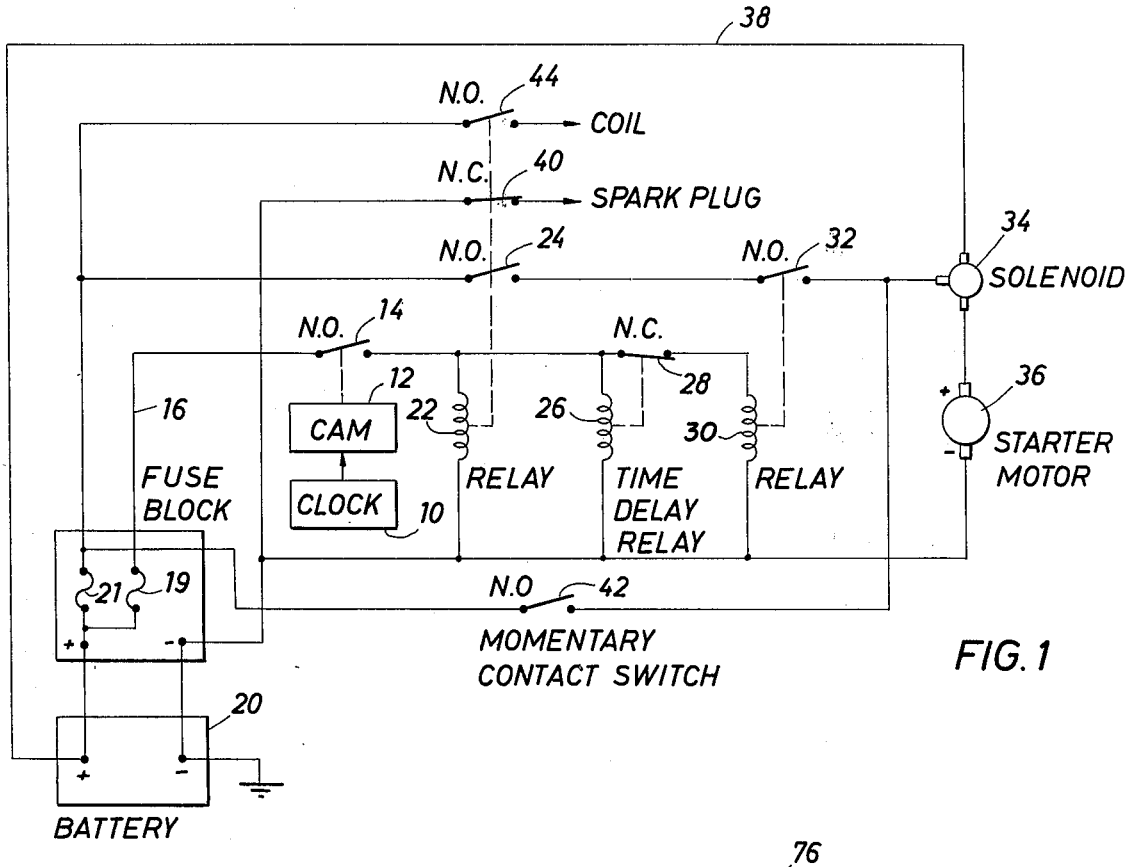
FIG. 1 is a schematic diagram of a first preferred embodiment of the present invention.

Now referring to the drawings and first to FIG. 1, there is a schematic illustration of a first preferred embodiment of the automatic start/stop control apparatus for cyclical engine operation in accordance with the present invention.

A time clock 10 is connected to a cam 12 for periodic cam operation. For the sake of simplicity, it can be assumed that clock 10 operates the cam once every 24 hours (although multi-sided cams can be provided for more frequent operation during a 24-hour period). Clock 10 conveniently operates with respect to its own "C" or "D" cell battery.

Cam 12 operates to close normally open microswitch 14. Once cam 12 operates to close the microswitch, it remains in the closed position for quite some time, for example, 2–10 hours. The closing of microswitch 14 connects an applied dc potential on line 16 from fuse box 18, via a first fuse 19, which is connected to the positive terminal of battery 20 or other dc source.

The dc potential from microswitch 14 provides an energizing path for coil 22 of a power relay for activating related, normally open switch contacts 24. These contacts are connected to a second fuse 21 in fuse box 18, which fuse is also connected to the positive terminal of battery 20.

Closing of contacts 14 also provides energizing of the coil of time delay switch 26. The normally closed contacts 28 of time delay relay 26 are opened after a predetermined length of time, normally on the order of 7–11 seconds. While closed, however, normally closed contacts 28 provide a path for the energization of the coil of power relay 30.

The normally open contacts 32 of power relay 30 are connected in the power path in series with normally open contacts 24 to provide a power connection to a magneto style ignition system including solenoid 34, connected to starting motor 36 of the engine (not shown). Hence, when both contacts 24 and 32 are closed, starting power is applied to solenoid 34. Typically, if everything is properly operational, the engine starts in the allotted time that normally closed switch 28 remains closed.

Running power is provided on line 38, which is connected directly to the battery. Therefore, provided that the engine starts during the time which contacts 28 of time delay relay are closed, which determines the time that contacts 32 in the power path to the solenoid are closed, the opening of the switch contacts of the time delay relay will have no effect on motor operation. The engine will continue to run as long as it is otherwise functionally operable (e.g., has fuel) and so long as cam 12 maintains closed normally open microswitch 14. When the time clock moves the cam to a position to permit microswitch 14 to open, then relay coil 22 becomes deenergized and permits normally closed spark plug connection contacts to close to connect the spark plug to the common or ground side of the battery. Grounding of the spark plugs shorts the engine and causes the engine to stop running. The engine will remain stopped until microswitch 14 is again closed in the manner previously described, which also removes the ground from the spark plug at contacts 40 with the energization of coil 22. The engine then again starts in the same manner as described above.

It should be noted that if normally closed contacts 28 open before the motor starts, because the starter motor does not catch within the 7–11 seconds permitted, only relay coil 30 is deenergized to open the power path to solenoid 34 via contacts 32. However, contacts 28 will remain open until the time delay relay is deenergized and reenergized as determined by the operation of contacts 14 by cam 12. Hence, the engine will not run during a period of time predetermined by the operation of cam 12. Hopefully, the subsequent attempt to start the motor will be successful through the operation which has previously been described.

For purposes of testing the engine at the time of installation or maintenance, it is possible to manually start the engine by disconnecting the lead to the spark plugs and closing momentary contacts 42, which contacts are connected to the positive terminal of fuse 21. This supplies dc potential to the solenoid as if contacts 24 and 32 were closed.

Finally, some engines operate with respect to a heater coil and not with respect to spark plugs. In such event, connection contacts 44 provide means for disconnecting the engine after a predetermined period of operation has expired in lieu of spark plug connection contacts 40. Contacts 44 are normally open and are activated by relay coil 22 to connect the heater coil (not shown) at the start of the predetermined operating period. When the period expires and the relay coil is deenergized, then these contacts are open to remove power from the heater coil, thereby stopping the engine.

Separate fusing separates the power path connections from the connections to the various relay coils.

Figure 2:
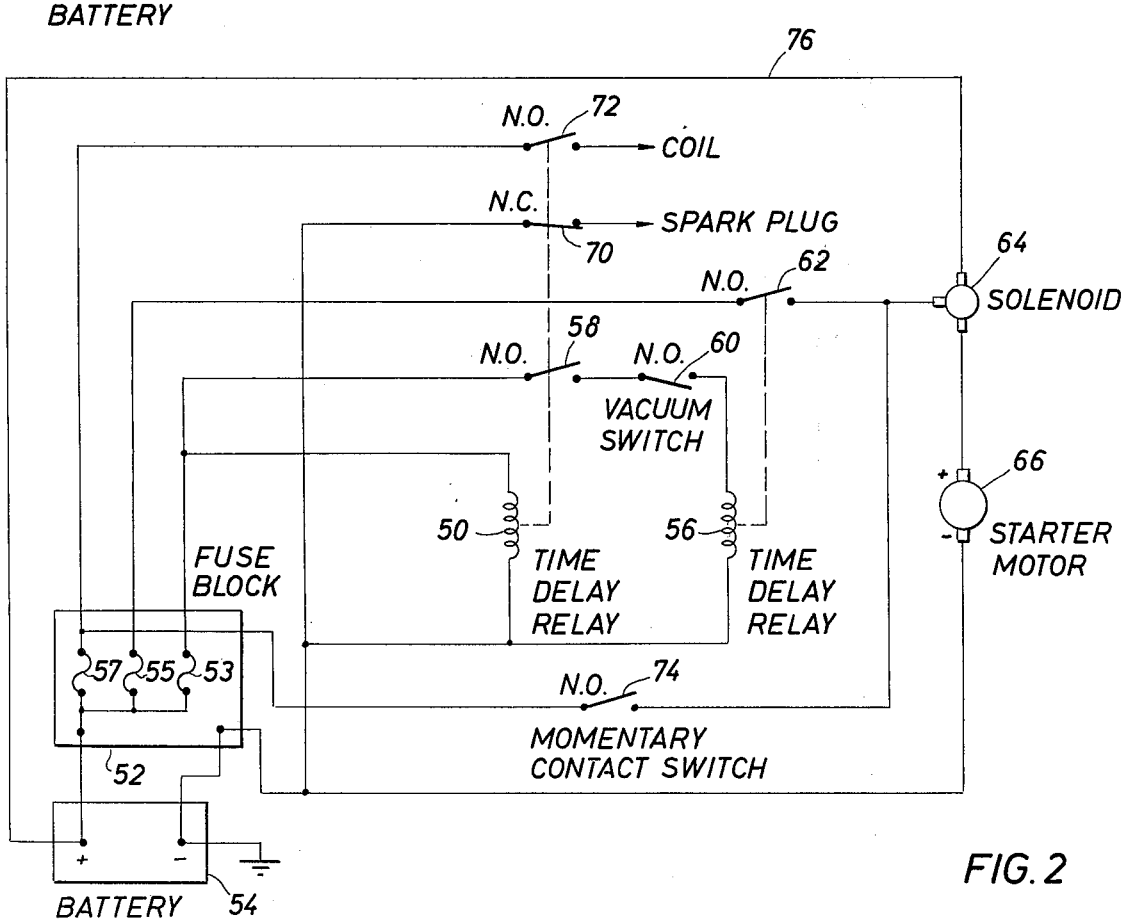
FIG. 2 is a schematic diagram of a second preferred embodiment of the present invention.

Now referring to FIG. 2, a preferred embodiment of the present invention is schematically shown employing two adjustable time delay relays. First, time delay relay 50 includes an ON setting, typically adjustable between three minutes and four hours, and an OFF setting, typically adjustable between eight minutes and twelve hours. That is, the operation is controllable so that, depending upon the position setting of the two adjustable switches, the relay acts as a switch for applying power therethrough, in this case, "+" power from fuse 53 in block 52 from battery 54. For example, the contacts of the time delay relay apply power in a manner to be hereafter described for a period of between two and ten hours, at the conclusion of which power is disconnected for the period which also may be several hours. Coil 56 of the second time delay relay only has a single setting, since it is externally turned on by the application of power thereto. Setting of this time delay relay is typically over a range of between 0.5 and 30 seconds. This means that after the relay is externally turned on, the relay remains energized for a period of time depending on the position of the adjustable setting, at which time the relay coil is deenergized and the accompanying switch contacts return to their normal position.

One connection from fuse 53 is through normally open contacts 58 operated in conjunction with coil 50 of the first time delay relay and normally opened contacts 60 of a vacuum switch (to be described later) to be applied to the coil of relay 56. Normally open contacts 62, operated by the coil of time delay relay 56, provide power from a second fuse 55 in fuse block 52 to solenoid 64, connected to starter motor 66.

In operation of the FIG. 2 circuit, power is applied to the first time delay relay, which energizes in accordance with the adjustable settings to close normally open contacts 58. Power energizes relay coil 56 through vacuum switch 60 to close normally open contacts 62 and apply power to the solenoid for the period of time that coil 56 of the second time delay relay is energized. If the engine does not start within the permitted time as determined by the second time delay relay, then contacts 62 open to remove starting power from the solenoid.

Vacuum switch 60 is connected to sense the presence of a vacuum in the engine manifold for a purpose to be described that provides an operational advantage of the FIG. 2 circuit with respect to the FIG. 1 circuit concerning the disconnecting of starting power when the engine does start. In the FIG. 1 circuit, it may be recalled power is applied to the engine solenoid for 7–11 seconds even if the engine turns over in the first second of applied power or for so long as time delay relay 26 remains energized. However, in the FIG. 2 circuit, as soon as the engine is started and a vacuum is pulled in the manifold, switch 60 opens to remove power from relay coil 56 which, in turn, opens contacts 62. This removes power even though relay coil 56 is still timed to be closed. Therefore, the solenoid does not crank away after the engine is started.

If the engine runs for a while and then dies, the FIG. 1 circuit would not immediately try to restart the engine but would wait until cam 12 runs its cycle to open contacts 14 and then close them again as determined by the operation of clock 10. However, in the FIG. 2 circuit, so long as time delay relay 50 is energized so that normally open contacts 58 are closed, the dying of the engine merely closes vacuum switch 60 to reestablish energizing power to time delay relay coil 56. This would close normally open contacts 62 and reestablish starting power to solenoid to 64. Hopefully, the application of power will cause the starting of the motor during the new time period determined by the second time delay relay.

As in the FIG. 1 embodiment, the FIG. 2 embodiment includes a ground connection to the spark plugs through a set of normally closed contacts, in this case contacts 70 operated by time delay relay coil 50. That is, to disconnect power from the engine, time delay relay coil 50, upon deenergization, operates to close the contacts to the spark plugs and to complete a shorting connection to ground or common.

For engines operating with respect to a heater coil, rather than with respect to spark plugs, normally open contacts 72 connected to fuse 57 is operated by time delay relay coil 50, to open when time delay relay coil 50 is deenergized.

Also, as with the FIG. 1 embodiment, a momentary contact switch 74 is provided for manually applying power to solenoid 64.

Running power is provided on line 76, connected directly to the battery. The separate fusing is convenient to isolate the power connection from the circuit operating the various relay coils.

Please note that particularly with respect to time delay relay contacts 62, there is no need for an auxiliary relay, such as in FIG. 1, since the contacts are capable of handling the power which is applied therethrough to solenoid 64. It has been found convenient to use Model TFR0205(15)(16) available from Syracuse Electronics Corporation for time delay relay 50 and to use Model TVR00508 for time delay relay 56 in the FIG. 2 circuit. Alternatively, a thermostatic delay relay from Amperite Co., Inc. can also be used as time delay relay 56.

Also, Model J54963022 having a switch rating of 15 amps from United Electronic Controls Co. has been used as vacuum switch 60.

Engines operating on diesel fuel, gasoline, butane, natural gas or the like, can be operated successfully at oil field sites using the inventive cyclical or periodic control system just described. The source of electric power, although indicated on the drawings as being from a battery, can be from commercial service lines. The circuit is simple but reliable and is adequate for operating in the manner just described, which is far superior to having to manually attend to cyclical operation of the engine or to use the complex structures that have been proposed in the prior art.

It is further convenient to use the automatic start/-stop control system just described for periodically operating an irrigation pump and for many other cyclical engine operations where it is inconvenient to have someone in attendance each time the engine is started or stopped. Even a water well is preferably operated using the above-described system, rather than using a continuously operating engine and pump.

Using the control system which has just been described also minimizes the required attendance for maintenance purposes only, such as checking the gasoline supply, oil condition and for normal preventive maintenance, such as checking spark plug wear and the like.

An engine that has been conveniently operated using the system which has just been described is a 16 HP Tucumseh air cooled, one cylinder, electric rectifier charging system and having an automatic-centrifugal clutch. Such an engine starts with its clutch disengaged until it reaches about 1300 rpm. At that point the automatic clutch engages so that by the time it reaches 1400–1500 rpm operation, which is normal for providing 15 strokes per minute to a pumping unit, depending on the pulley size, the clutch is fully engaged.

While particular embodiments of the invention have been shown and described, it will be understood that the invention is not limited thereto, since modifications may be made and will become apparent to those skilled in the art.

What is claimed is:

1. Automatic control apparatus for cyclical engine operation, comprising;

first timer means including a normally open switch for applying power therethrough when said switch is closed, said switch being closed at predetermined clock intervals, second timer means activated by said first timer means, and solenoid means connected to said second timer means, the closing of said solenoid means applying starting power to the engine, said second timer means deactivating after a predetermined time from being activated to open said solenoid means, and said first timer means including;

a clock, cam means operated by said clock including a second normally open switch, and a relay having a relay coil energized by the closing of said second normally open switch, the energization of said coil closing said first-named normally open switch at predetermined clock intervals.

2. Automatic control apparatus in accordance with claim 1, wherein said cam closes said second normally open switch for approximately 2–10 hours out of each 24-hour clock period.

3. Automatic control apparatus in accordance with claim 1, wherein said second timer means includes a time delay relay actuated by the closing of said second switch of said first timer means, and a normally closed switch operated open by said time delay relay after a second predetermined clock interval.

4. Automatic control apparatus in accordance with claim 3, wherein said time delay relay operates to open said normally closed switch approximately 7–11 seconds after actuation.

5. Automatic control apparatus in accordance with claim 3, wherein said second timer means additionally includes a normally open relay, the coil of which is energized through said normally closed switch, the relay contacts of which provide a power path to said solenoid means.

6. Automatic control apparatus in accordance with claim 3, wherein said time delay relay of said second timer means includes a variable control means for determining said second predetermined clock interval.

7. Automatic control apparatus for cyclical engine operation, comprising;

first timer means including a normally open switch for applying power therethrough when said switch is closed, said switch being closed at predetermined clock intervals, second timer means activated by said first timer means, solenoid means connected to said second timer means, the closing of said solenoid means applying starting power to the engine, said second timer means deactivating after a predetermined time from being activated to open said solenoid means and , said first timer means including a variable time delay relay, and control means, said normally open switch includes contacts associated with said variable time delay relay, said control means setting the open-to-close ratio of said contacts of said variable time delay relay.

8. Automatic control apparatus in accordance with claim 7, wherein said engine includes at least one spark plug, and said first timer means includes a normally closed engine stop switch means connected to said spark plug opening during each of said predetermined clock intervals and then closing to ground the engine spark plug to stop the engine.

9. Automatic control apparatus in accordance with claim 7, wherein said engine includes a coil, and said first timer means includes a normally open engine stop switch means to connect power to said coil, said switch means closing during each of said predetermined clock intervals and then opening to remove power from said coil to stop the engine.

10. Automatic control apparatus in accordance with claim 7, and including vacuum switch means connected to sense the presence of a vacuum in the engine manifold, the sensing of such vacuum deactivating said second timer means to open said solenoid means.

11. Automatic control apparatus in accordance with claim 7, and including a momentary contact switch connecting power directly to said solenoid means for manually operating said solenoid means.

* * * * *